United States Patent [19]

Hintsch et al.

[11] 4,427,035

[45] Jan. 24, 1984

[54] CLUTCH ARRANGEMENT FOR A HEDDLE OF A WEAVING MACHINE

[75] Inventors: Otto Hintsch; Werner Julich, both of Wallisellen, Switzerland

[73] Assignee: Sulzer Brothers Limited, Winterthur, Switzerland

[21] Appl. No.: 302,663

[22] Filed: Sep. 15, 1981

[30] Foreign Application Priority Data

Sep. 19, 1980 [EP] European Pat. Off. ..... 80105632

[51] Int. Cl.[3] ..... F16D 11/06; D03C 1/00

[52] U.S. Cl. ..... 139/76; 139/66 R; 192/33 R; 192/28; 192/71

[58] Field of Search ..... 192/33 R, 71, 28, 29, 192/30 V; 139/76, 66 R

[56] References Cited

U.S. PATENT DOCUMENTS 2,853,169 9/1958 Usselmann ..... 192/33 R
4,230,210 10/1980 Hintsch ..... 192/28

FOREIGN PATENT DOCUMENTS 1154048 4/1964 Fed. Rep. of Germany .
1710190 10/1971 Fed. Rep. of Germany .
2741199 2/1979 Fed. Rep. of Germany .
606022 4/1978 U.S.S.R. ..... 192/28

*Primary Examiner*—Rodney H. Bonck
*Assistant Examiner*—James J. Merek
*Attorney, Agent, or Firm*—Kenyon & Kenyon

[57] ABSTRACT

The clutch contains a spring for pulling the arm of the control lever on the stop and an additional auxiliary spring connected with a roller. While the control lever strikes on the stop, the roller moves toward one lever arm so that in a further rotation of the parts, the roller (30) is lifted within a slot while additionally tensioning the auxiliary spring. While the tension of the main spring decreases, that of the auxiliary spring increases correspondingly, so that the control lever is held with sufficient tension on the stop and machine vibrations during the striking or operation can be made harmless or damped.

4 Claims, 3 Drawing Figures

9
8
11
7
6
5
3
2
61
4
18
66
1
2
60
18
14
16
33
32
41
12
15
22
21
17
13
31
30a
23a
24
54
55
26
40
28
25
27

CLUTCH ARRANGEMENT FOR A HEDDLE OF A WEAVING MACHINE

This invention relates to a clutch arrangement for controlling a heddle of a weaving machine.

As is known, various types of arrangements have been used for controlling the operation of the heddles of a weaving machine such as a power loom. For example, as described in German A.S. 11 54 048 one known clutch arrangement utilizes an intermittently rotatable drive shaft having at least one slot, a pawl which can be engaged in the slot and which is disposed on an eccentric rotatably mounted on the drive shaft as well as a strap for crank rod of a heddle drive which is disposed about the eccentric. In addition, at least one control lever is movable into the path of the pawl so as to disengage the pawl from the drive shaft. This control lever is pivoted back and forth by means of a stroke meter drive and pulled against a stationary stop by a spring.

In this clutch arrangement, the control lever is brought into an operating position in which the pawl can be disengaged by the stroke meter drive. If the control lever is to be returned into an inoperative position under the influence of the spring, by which the control lever is pressed against a stop, the spring has the least deflection in the stop position and, thus, the least tension. The control lever therefore tends to vibrate when striking against the stop, so that the lever does not stop at once, and cannot be held in a rest position with sufficient force.

Accordingly, it is an object of the invention to provide a clutch arrangement for a heddle which can be operated with a minimum of vibration.

It is another object of the invention to provide for the reliable operation of a clutch arrangement for a heddle.

Briefly, the invention provides a clutch arrangement for controlling the heddles of a power loom. The clutch arrangement includes an intermittently rotatable drive shaft having at least one slot, an eccentric rotatably mounted on the shaft, a pawl mounted on the eccentric for engagement in the slot of the shaft and a strap or link for a crank rod of heddle drive about the eccentric. In addition, the arrangement includes at least one control lever which is movable between a blocking position in the path of the pawl and a release position spaced from the pawl as well as a stroke meter drive for moving the lever between these positions. Still further, the arrangement has a stationary stop, a spring biasing the control lever toward the stop in the blocking position and an auxiliary spring which biases the control lever against the stop when in the blocking position.

Pressing the control lever on the stop results in having the control lever held under a particularly strong spring force when striking against the stationary stop. The force of the main retractile spring, which is relatively weak in this position, can thus be supplemented by the force of the auxiliary spring. Thus, vibrations which might otherwise occur during striking of the control lever against the stop can be avoided or substantially reduced.

As a note, during operation, the control lever cannot be moved out of the blocking or operating position by machine vibrations because of the control abutment of the lever against the stop. The disengagement of the pawl of the clutch arrangement corresponding to this position can therefore be effected in a very reliable manner. These and other objects and advantages of the invention will become more apparent from the following detailed description taken in conjunction with the accompanying drawings wherein.

Figures 1, 3:
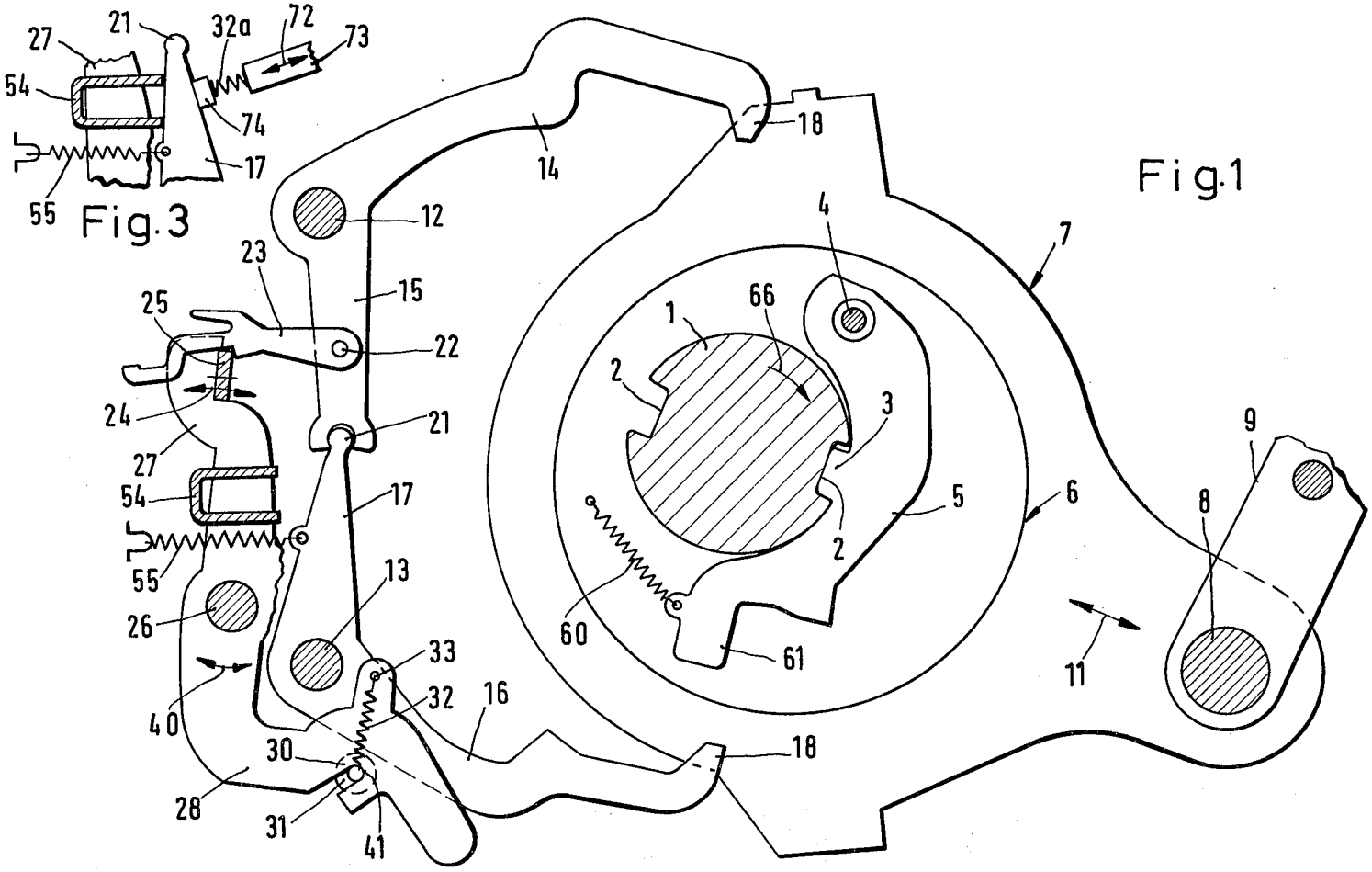
FIG. 1 illustrates a sectional view of a clutch arrangement according to the invention.
FIG. 3 illustrates a detail of a modified clutch arrangement according to the invention.

Referring to FIG. 1, the clutch arrangement is used for controlling a heddle (not shown) of a weaving machine, for example a power loom. As indicated, the clutch arrangement incorporates a drive shaft 1 which is intermittently rotatable in the direction indicated by the arrow 66 in increments of 180° off a main shaft (not shown) of the weaving machine. The drive shaft 1 includes a pair of diametrically opposed slots 2 for selectively receiving a nose 3 of a pawl 5 which is pivotally mounted by a suitable pivot 4 on an eccentric 6. The eccentric 6 is, in turn, rotatably mounted on the drive shaft 1 for purposes as described below. As shown, an extension spring 60 is secured to a free end of the pawl 5 and to the eccentric 6 so as to bias the pawl 5 towards the drive shaft 1.

In addition, a link or strap 7 for a crank rod (not shown) of a heddle drive is disposed about the eccentric 6. The strap 7 is articulated at a pivot point 8 to a transmission linkage 9 so as to transfer a reciprocating movement of the strap 7 which occurs in the direction indicated by the arrow 11 to the associated heddle of the loom.

Of note, the drive shaft 1 mounts a plurality, for example six to twelve of the drive parts 6, 7 for each heddle of the loom. Thus, the drive shaft 1, eccentrics 6 and straps 7 form the so-called eccentric machine for the drive and control of all heddles of the loom. The heddles are thus movable according to a weaving program for the wrap threads in a high or low shed position.

In order to actuate the pawl 5 during operation, the clutch arrangement employs a pair of two-armed control levers 14, 15, 16, 17 which are pivotally mounted on fixed bearing pins 12, 13 to move between a blocking position and a release position. As shown, each lever has a hook 18 at the free end which can be moved into the path of the pawl 5 in the blocking position. In addition, the two control levers are connected via the arms 15, 17 in an articulated joint 21.

The clutch arrangement also has a bar 23 which is pivotally connected via a pin 22 to the arm 15 of one lever for moving the control levers between a blocking position and a release position (not shown). This bar 23 is, in turn, movable between an operative position as shown in FIG. 1 to cooperate with a stroke meter drive and an inoperative position out of the influence of the stroke meter drive 25 (not shown). As indicated in FIG. 1, the stroke meter drive has a bar 25 which is movable in a back and forth direction as indicated by the arrow 24.

The stroke meter drive bar 25 is secured on a two-arm driving lever 27, 28 which can be pivoted back and forth about a pivot 26. Arm 28 contains a slot 31 in which a roller 30 is movably mounted. The roller 30 is under the action of a spring 32 and extends over the entire length of drive shaft 1, thus covering all juxtaposed control lever 16, 17. The spring 32 is secured at the other end at a point 33 on the arm 28 which is located between a stop 54 and the roller 30 taken in the direction of movement of the lever 27, 28 toward the stop 54.

As indicated, the stop 54 is stationary and a spring 55 biases the control lever 16, 17 towards the stop 54 in the blocking position of the control lever 16, 17.

The mode of operation is as follows: In the engaged position of the pawl 5 according to FIG. 1, the rotary movement of the shaft 1 is transmitted in the direction indicated by the direction of arrow 66 over the pawl 5 to the eccentric 6, so that the link 7 and rods 9 are moved back and forth in the direction indicated by the arrow 11, and the respective heddle alternately is moved from a top shed position into a bottom shed position and back. The bar 23 is in engagement with the stroke meter bar 25 and is moved to the right when the stroke meter bar in FIG. 1 is moved to the right by the action of spring 55. The two control levers 14 to 17 thus arrive in the inoperative release position shown in FIG. 1, in which the end 61 of the pawl 5 can pass under the two hooks 18 of control levers 14 to 17 without being engaged by them.

During the movement of stroke meter bar 25 in FIG. 1, the bar 23 and the arms 15, 17 of the control levers follow to the left under the action of the spring 55, so that the control levers are temporarily in the operating position. The end 61 of the pawl 5 however, is not in the range of one of the hooks at this time. In the following movement of the stoke meter bar 25 to the right, the parts are moved again into the position according to FIG. 1. During all these movements the roller 30 remins in a bottom 41 of the slot 31.

Figure 2:
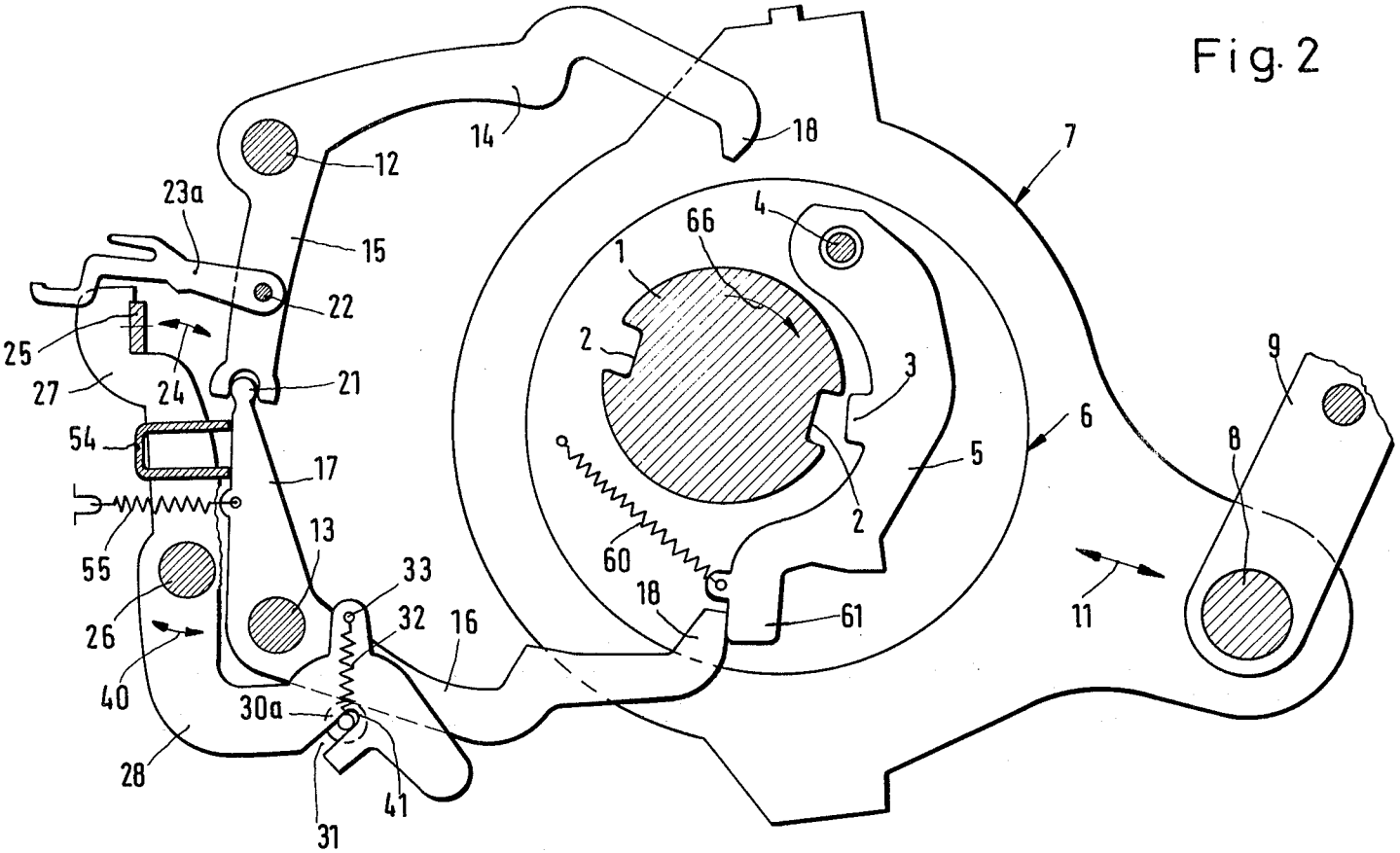
FIG. 2 illustrates a view similar to FIG. 1 of the clutch arrangement in an operating position.

In order to stop the heddle in the top shed-or bottom shed position, the pawl 23 is lifted by a program control device (not shown) at the end of a left stroke of the stroke meter bar 25 from the engaged position in FIG. 1 into the inoperative top position 23*a* (FIG. 2), in which the pawl 23 is out of engagement with the stroke meter bar 25. Shortly the arm 17 strikes against the stop 54, the roller 30 moves toward the arm 16 during the further movement of the lever 27, 28 in the direction indicated by the arrow 40, the arm 28 continues to move counter-clockwise. Thus, the roller 30 rises from the bottom 41 of the slot 31, while additionally tensioning the tension spring 32. This results in the position according to FIG. 2.

While the spring 55 receives less tension when the arm 17 strikes against the stop 54, the tension of the auxiliary spring 32 increases correspondingly, so that the control lever 16, 17 strikes against the stop 54 with sufficient tension making machine vibrations substantially harmless during the striking and the following operation. The arm 17 is held firmly on the stop 54 under sufficient tension of the spring 55 and particularly the auxiliary spring 32. The roller 30 thus has a damping effect on the striking or the machine vibrations. In the position according to FIG. 2, the end 61 of the pawl 5 strikes against one of the hooks 18 of the control levers 14 to 17, so that the disengaged position according to FIG. 2 of the pawl 5 is obtained. In this position, the eccentric 6, link 7, rods 9 and the respective heddle are in a rest position.

Referring to FIG. 3, wherein like reference characters indicate like parts as above, the auxiliary spring 32*a* is mounted on a bar 73 which is reciprocally mounted for moving back and forth in the direction indicated by the arrow 72. The bar 73 is moved to the left in FIG. 3 shortly before arm 17 strikes against the stop 54. The auxiliary spring 32*a* which carries a head disk 74 is thus moved toward the arm 17. The leftward movement of the parts 73, 32*a*, 74 is somewhat faster than the movement of the arm 17. After the arm 17 strikes against the stop 54, the bar 73 is still moved for a short time to the left, so that the auxiliary spring 32*a* is further tensioned, with the head disk 74 standing still. In this embodiment, an additional pressure is also exerted on the arm 17. During the following rightward movement of the arm 17, the parts 73, 32*a*, 74 are moved faster to the right, as viewed, than the arm 17 in its rightward movement. Auxiliary spring 32*a* thus relaxes, and the head disk 74 is lifted from the arm 17, and the distance between the disc 74 and arm 17 increases.

What is claimed is:

1. A clutch arrangement for controlling a heddle of a power loom, said arrangement comprising an intermittently rotatable drive shaft having at least one slot therein;

an eccentric rotatably mounted on said shaft for driving a heddle;

a pawl mounted on said eccentric for engagement in said slot of said shaft;

at least one control lever movable between a blocking position in the path of said pawl and a release position spaced from said pawl;

a stroke meter drive for moving said lever between said positions;

a stationary stop;

a spring biasing said control lever towards said stop in said blocking position; and an auxiliary spring biasing said control lever against said stop in said blocking position.

2. A clutch arrangement as set forth in claim 1 wherein said stroke meter drive includes a pivotally mounted lever having a slot therein, and a roller disposed in said slot and extending transversely of said control lever, said auxiliary spring being secured between and to said roller and said pivotally mounted lever to bias said roller against control lever in said blocking position.

3. A clutch arrangement as set forth in claim 2 wherein said auxiliary spring is secured to said pivotally mounted lever at a point between said stop and said roller taken in a direction of movement of said latter lever toward said stop.

4. A clutch arrangement as set forth in claim 1 which further comprises a reciprocally mounted bar for moving in a direction towards said stop, said bar having said auxiliary spring mounted thereon, and a head disc mounted on said auxiliary spring to abut said control lever with said control lever abutting said stop.

* * * * *